US006460709B1

(12) United States Patent
Hurt

(10) Patent No.: US 6,460,709 B1
(45) Date of Patent: Oct. 8, 2002

(54) STORAGE DEVICE

(75) Inventor: Daniel P. Hurt, Edina, MN (US)

(73) Assignee: Vertex International, Farmington, MN (US)

( * ) Notice: Subject to any disclaimer, the term of this patent is extended or adjusted under 35 U.S.C. 154(b) by 0 days.

(21) Appl. No.: 09/767,440

(22) Filed: Jan. 23, 2001

(51) Int. Cl.[7] ..... A47F 5/08
(52) U.S. Cl. ..... 211/87.01; 211/90.01
(58) Field of Search ..... 211/87.01, 90.01, 211/126.3

(56) References Cited

U.S. PATENT DOCUMENTS 3,581,906 A * 6/1971 Joyce ..... 211/88.01
4,467,927 A * 8/1984 Nathan ..... 211/186
4,664,266 A * 5/1987 Fausett et al. ..... 211/87.01
4,708,310 A * 11/1987 Smith ..... 211/90.01
5,289,927 A * 3/1994 Emery ..... 211/87.01
5,971,174 A * 10/1999 Strock ..... 211/186
5,992,654 A * 11/1999 Dente, Jr. ..... 211/90.01
6,059,128 A * 5/2000 Wang ..... 211/90.01
6,173,847 B1 * 1/2001 Zellner, III et al. ..... 211/186

* cited by examiner

*Primary Examiner*—Daniel P. Stodola
*Assistant Examiner*—Erica B. Harris
(74) *Attorney, Agent, or Firm*—Haugen Law Firm PLLP

(57) ABSTRACT

A storage device for storing and organizing various articles in interior corners includes a frame having first, second, and third sides, wherein the first and second sides are substantially perpendicular to one another, and the third side extends between respective distal ends of the first and second sides. The frame further includes one or more ribs extending between two of the first, second, and third sides to thereby define a plurality of open chambers in the interior space between the first, second, and third sides. In a particular embodiment, the frame is adapted to receive fasteners through the first and second sides to removably and horizontally attach the frame to respective adjacent walls.

9 Claims, 2 Drawing Sheets

20
72
36
14
10
12
52
50
51
50
52
22
72
68
68
16
68
72
28

68
68
16
68
22
72
28
72
50
52
74
76
60
52
50
60
12
14
38
60
60
10
72
20

STORAGE DEVICE

FIELD OF THE INVENTION

The present invention relates to storage devices generally, and more particularly to devices for storing and organizing various items adjacent to walls.

BACKGROUND OF THE INVENTION

A number of storage/organizing devices have been developed to provide convenient storing means for various objects. Such devices include modular shelving units, rotatable racks, and drawer systems, among several others. Such devices, however, are limited in their utility by their geometrical configurations. For example, storing/organizing devices commonly in use today typically utilize rectangular configurations, whereby interior corners of rooms or other structures are not efficiently utilized. In addition, typical storage devices in use today do not have the capability of storing a variety of objects including handled implements in a compact space.

Thus, it is a principle object of the present invention to provide a device for efficiently storing various articles in a compact space, such as in an interior corner.

It is a further object of the present invention to provide a device for storing various articles including handled implements in interior corners.

It is a still further object of the present invention to provide a wall-mountable device for storing various articles in compact spaces.

It is a yet further object of the present invention to provide a self-supporting device for storing various articles in interior corners.

SUMMARY OF THE INVENTION

By means of the present invention, utilization of spaces, such as interior corners of rooms and other structures for storage purposes, is improved by providing a storage device that is adaptable to such spaces. The storage device of the present invention is preferably configured to abut adjacent walls, particularly converging adjacent walls forming interior corners. The storage device of the present invention is also preferably configured to store articles of various sizes and shapes.

A particular embodiment of the storage device of the present invention includes a substantially triangular frame having first, second, and third sides, wherein the first and second sides are substantially perpendicular to one another, and the third side extends between respective distal ends of the first and second sides. The first, second, and third sides, in combination, define an interior space therebetween, which interior space preferably includes one or more ribs extending between two of the first, second, and third sides through the interior space, thereby defining a plurality of open chambers in the interior space. The storage device is preferably configured to be placed in an interior corner defined by adjacent perpendicular walls such that the first and second sides are substantially propinquant to the respective adjacent walls. Additionally, the first and second sides are adapted to receive fasteners therethrough to removably and horizontally attach the storage device to the adjacent walls.

Particular features of the preferred embodiment include slots disposed in the first and second sides for receiving the fasteners therethrough. The storage device of the present invention also preferably includes one or more protrusions extending outwardly from the third side for grasping additional articles thereon.

An additional aspect of the present invention includes a plurality of post-receiving bores for receiving support posts therein such that the storage device may be supported by the posts. In such an embodiment, the bores may both extend vertically from a bottom surface to a midpoint between the bottom surface and the top surface, and extend vertically from the top surface to the midpoint.

DETAILED DESCRIPTION OF THE PREFERRED EMBODIMENTS

The objects and advantages enumerated above together with other objects, features and advances represented by the present invention will now be presented in terms of detailed embodiments described with reference to the attached drawing figures, which are intended to be representative of various possible configurations of the invention. Other embodiments and aspects of the invention are recognized as being within the grasp of those having ordinary skill in the art.

Figure 1:
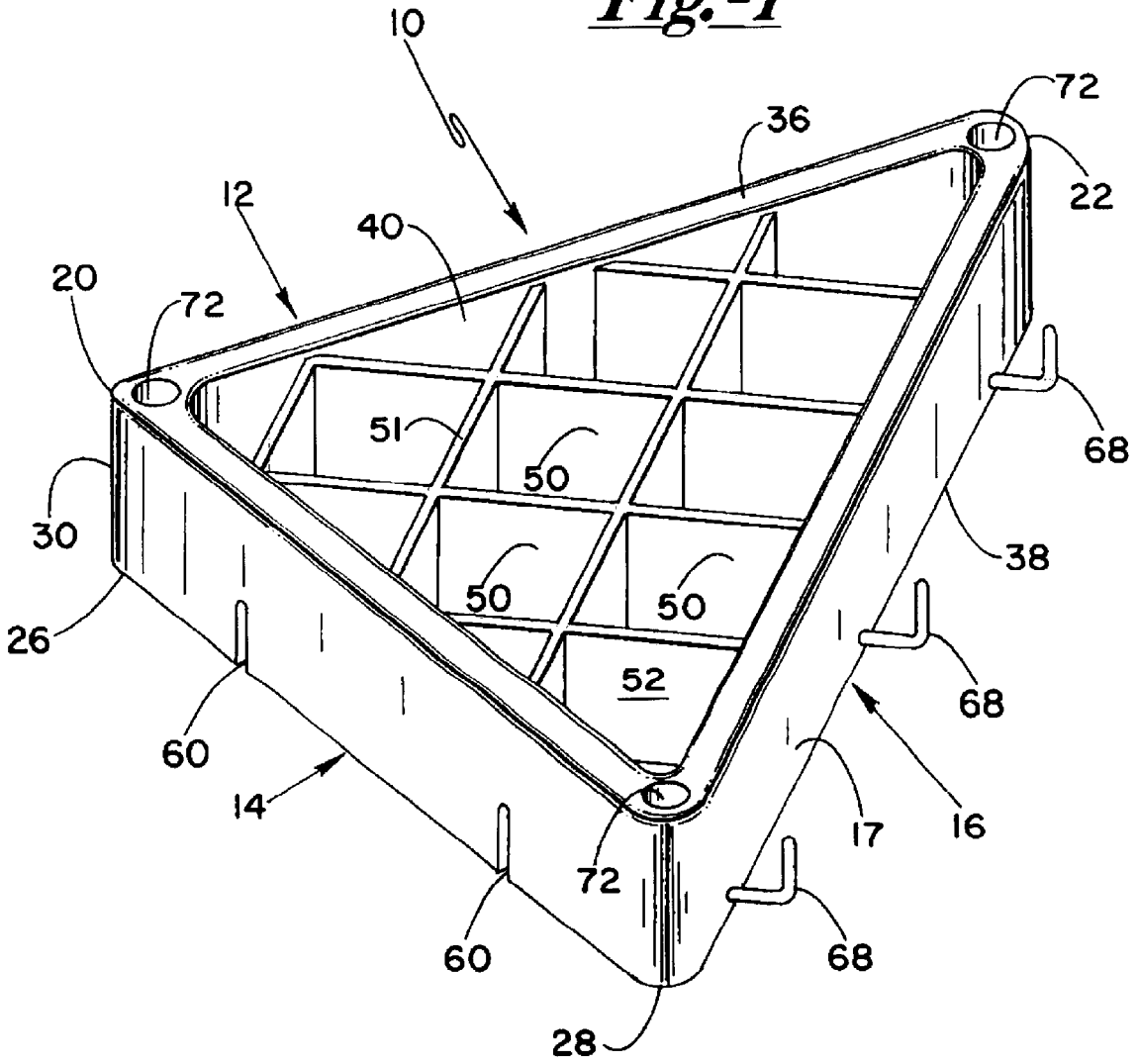
FIG. 1 is a perspective view showing the storage device of the present invention.

Referring now by characters of reference to the drawings, and first to FIG. 1, a storage device 10 of the present invention is shown. As illustrated in FIG. 1, storage device 10 is substantially triangular, and includes a first side 12, a second side 14, and a third side 16. In preferred embodiments, first side 12 and second side 14 are substantially perpendicular to one another, though various other angular relationships are contemplated by the present invention. Side 12 further includes a proximal end 20 and a distal end 22, which proximal end 20 coincides with proximal end 26 of second side 14, thereby forming vertex 30. Second side 14 further includes a distal end 28. Third side 16 extends between respective distal ends 22, 28 of first and second sides 12, 14.

First, second, and third sides 12, 14, 16, in combination, define an upper surface 36 and a generally opposing lower surface 38. First, second, and third sides 12, 14, 16, in combination, further define an interior space therebetween as designated at 40.

In preferred embodiments of the present invention, storage device 10 includes one or more ribs 50 extending between two of sides 12, 14, 16 to thereby define a plurality of open chambers as designated at 52 in interior space 40. In such embodiments, various articles may be supported on upper surfaces 51 of ribs 50, or may be retained within open chambers 52. As shown in FIG. 1, chambers 52 are open between upper surface 36 and lower surface 38. Examples of articles that may be desirably retained within chambers 52 and thus conveniently stored include handled articles such as brooms, mops, shovels, hammers, and so on. Most preferably, a plurality of ribs 50 extend between respective sides 12, 14, 16, thereby defining a plurality of open chambers 52. Such chambers 52 may be of various dimensions, and a single storage device 10 may include a plurality of chambers 52 of various dimensions. Preferably, at least some of the chambers 52 are about 1.5 inches in width and about 2 inches in length.

In other embodiments of the present invention, at least a portion of interior space 40 may include a continuous flat or multiple-level surface for more efficiently storing various articles, particularly relatively small articles.

Storage device 10 is preferably sized and configured to be placed at or near the convergence of adjacent perpendicular walls. In particular, first and second sides 12, 14 are preferably configured to abut adjacent walls such that vertex 30 is substantially adjacent to the convergence of such perpendicular walls. In other embodiments of the present invention, the angular relationship between first and second sides 12, 14 may be non-perpendicular such that storage device 10 may be utilized in non-perpendicular applications.

The present invention further contemplates a variety of configurations that incorporate the desired angular relationship between first and second sides 12, 14. For example, storage device 10 may employ a variety of structural configurations in place of third side 16 including, but not limited to, curved surfaces, multiple-faceted surfaces, and discontinuous surfaces. It is therefore contemplated by the present invention that numerous configuration variants may be developed which harness the advantages stated herein.

The preferred configuration of storage device 10 as described above provides unique functionality not found in typical storage devices. In particular, storage device 10 efficiently utilizes space in interior corners created by the convergence of adjacent walls. Such interior corner space is often times ineffectively utilized with the configurations employed in common storage systems. Storage device 10 may be of any desired size, though in a particularly preferred embodiment, first and second sides 12, 14 are between about 6 inches and 24 inches in length, thus defining support surface area of between 18 inches squared and about 290 inches squared. Additionally, first, second, and third sides 12, 14, 16 are each preferably between about 0.25 inches and about 4 inches in height. Other sizes and configurations of storage device 10 are contemplated in the present invention to accomplish the stated goals which are not accomplished by typical systems in use today.

As shown in FIG. 1, storage device 10 may also include a plurality of slots 60 disposed in first and second sides 12, 14, wherein slots 60 are preferably sized and configured to receive fasteners therethrough to removably and horizontally attach storage device 10 to respective adjacent walls. Slots 60 preferably extend through respective sides 12, 14, and extend vertically a distance from bottom surface 38. Slots 60 may also be in the form of holes or other apertures, so long as fasteners may be received therethrough to removably attach storage device 10 to respective adjacent walls.

In preferred embodiments, storage device 10 may also include one or more protrusions 68 extending outwardly from an outer surface 17 of third side 16. Protrusions 68 are preferably directed upward, such that various items may be hung or grasped thereon for additional storage purposes.

Figure 2:
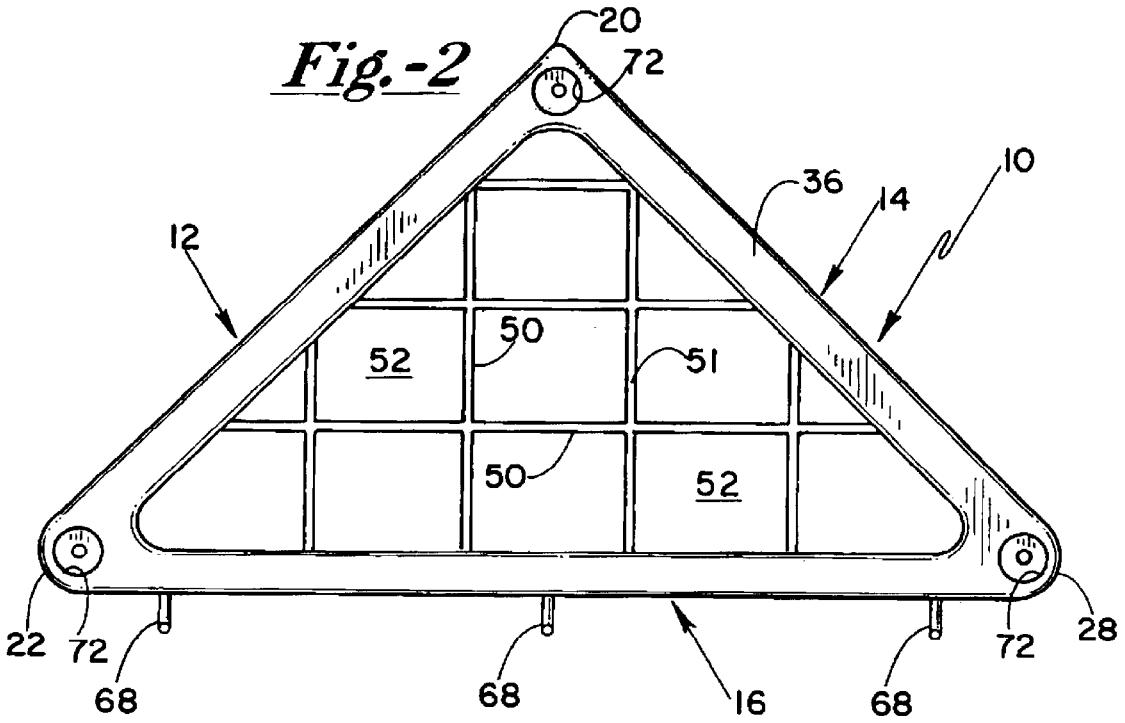
FIG. 2 is a top view showing the storage device illustrated in FIG. 1.
Figure 3:
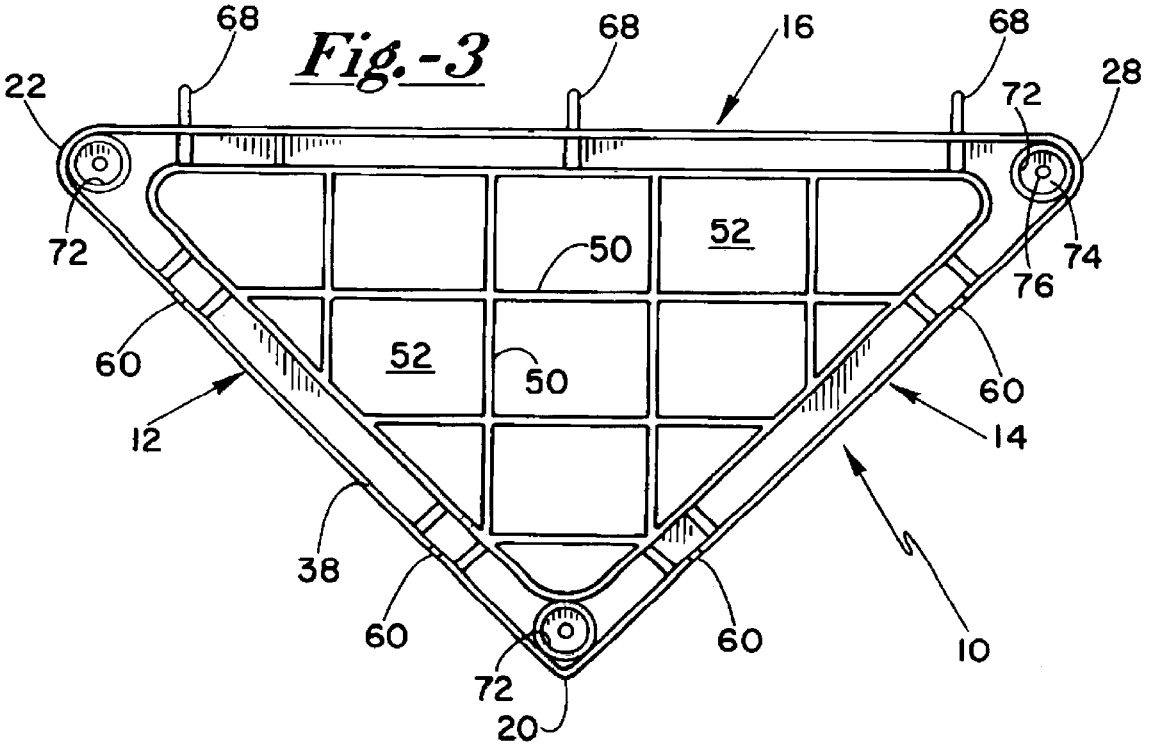
FIG. 3 is a bottom view showing the storage device illustrated in FIGS. 1 and 2.

Some embodiments of the present invention include post-receiving bores 72 for receiving support posts (not shown) therein. Post-receiving bores 72 may be more easily viewed in the top view of FIG. 2, or the bottom view of FIG. 3. As shown in FIGS. 2 and 3, post-receiving bores 72 generally form cylinders for receiving respective support posts. Bores 72 preferably extend vertically from a top surface 36 to a midpoint surface, as designated at 74, which midpoint surface 74 is located between upper surface 36 and lower surface 38, and between lower surface 38 and midpoint surface 74. In such a manner, any number of storage devices 10 may be utilized in combination to create an overall storage system. For example, two storage devices 10 may be utilized in combination as an upper storage device and a lower storage device respectively, wherein the two storage devices are coupled via support posts. The support posts may preferably be inserted into bores 72 through top surface 36 to form the bottom storage device, while the distal ends of the support posts may be inserted into bores 72 of the upper storage device through its respective lower surface 38. This process may be repeated such that a plurality of storage devices are created to form a multiple-surface storage system in a given interior corner.

Bores 72 are preferably located at respective ends of sides 12, 14, 16, but may be placed elsewhere for various applications. Additionally, bores 72 may be of any desired shape to receive correspondingly shaped support posts.

As illustrated in FIGS. 2 and 3, midpoint surface 74 preferably includes an aperture 76 therein, wherein aperture 76 forms an open channel extending through midpoint surface 74. Aperture 76 may be utilized for receiving support structures, such as coat hangers, plant hooks, or the like. It is contemplated that aperture 76 may be of any desired size and configuration, as limited by the size of bores 72. It is contemplated that aperture 76 may be of any desired size and configuration, as limited by the size of bores 72.

Storage device 10 is preferably fabricated from a lightweight, durable material. Storage device 10 is preferably manufactured from polymeric materials, or lightweight metals such as aluminum. Most preferably, storage device 10 is fabricated from polypropylene, and is injection molded.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A storage device comprising:

a frame having first, second, and third sides, said first and second sides being substantially perpendicular to one another, and said third side extending between respective distal ends of said first and second sides, said first, second, and third sides, in combination, defining an upper surface and an opposing lower surface of said frame, and an interior space in said frame, said frame being configured to be placed in an interior corner defined by adjacent perpendicular walls such that said first and second sides are substantially propinquant to respective said adjacent walls, said first and second sides being adapted to receive fasteners therethrough to removably and horizontally attach said frame to said adjacent walls, said frame including a plurality of post-receiving bores for operably receiving support posts therein such that said storage device may be supported by such posts, said bores extending transversely from said bottom surface to a midpoint surface between said bottom surface and said top surface, and from said top surface to said midpoint surface, each said midpoint surface including one or more apertures disposed therein; and a plurality of substantially rigid ribs extending between two of said first, second, and third sides in such interior space, thereby defining a plurality of open chambers extending between said upper surface and said lower surface in such interior space, which open chambers are specifically configured by said ribs to receive handled implements therethrough.

2. A storage device as in claim 1 wherein at least one of said chambers is about 1.5 inches in width and about 2 inches in length.

3. A storage device as in claim 1 wherein said ribs define chambers of various dimensions.

4. A storage device as in claim 1, including slots disposed in said first and second sides for receiving said fasteners.

5. A storage device as in claim 1, including one or more protrusions extending outwardly from said third side.

6. A storage device as in claim 1 wherein a plurality of distinct said frames may be interconnected via said support posts.

7. A storage device as in claim 1 wherein said frame comprises a polymeric material.

8. A storage device as in claim 7 wherein said frame comprises polypropylene.

9. A storage device as in claim 1 wherein said frame is substantially triangular.

* * * * *